US008215488B2

(12) United States Patent
Klos

(10) Patent No.: US 8,215,488 B2
(45) Date of Patent: Jul. 10, 2012

(54) SYSTEM AND METHOD OF PACKAGING

(75) Inventor: Kimberly Klos, Carlsbad, CA (US)

(73) Assignee: Ingram Micro Inc., Santa Ana, CA (US)

( * ) Notice: Subject to any disclaimer, the term of this patent is extended or adjusted under 35 U.S.C. 154(b) by 0 days.

(21) Appl. No.: 12/555,971

(22) Filed: Sep. 9, 2009
(Under 37 CFR 1.47)

(65) Prior Publication Data

US 2011/0139673 A1 Jun. 16, 2011

Related U.S. Application Data

(63) Continuation of application No. 12/359,944, filed on Jan. 26, 2009, now abandoned.

(60) Provisional application No. 61/023,396, filed on Jan. 24, 2008.

(51) Int. Cl.
*B65D 81/05* (2006.01)

(52) U.S. Cl. ..... 206/583; 206/462

(58) Field of Classification Search ..... 206/461, 206/471, 521, 583, 591–594, 462, 463
See application file for complete search history.

(56) References Cited

U.S. PATENT DOCUMENTS 1,571,908 A 2/1926 Menzies
1,966,669 A 7/1934 Johnson
2,638,211 A 5/1953 Spurr
3,173,540 A * 3/1965 Lapides ..... 206/463
3,692,264 A 9/1972 Burkhard et al.
4,606,460 A * 8/1986 Luray ..... 206/583
4,852,743 A 8/1989 Ridgeway
4,903,827 A * 2/1990 Phelps et al. ..... 206/472
4,923,065 A 5/1990 Ridgeway
5,056,665 A 10/1991 Boecker et al.
5,071,009 A 12/1991 Ridgeway
5,218,510 A * 6/1993 Bradford ..... 206/583
5,221,005 A 6/1993 Hayward
5,251,760 A 10/1993 Smith et al.
5,287,968 A 2/1994 Ridgeway
5,388,701 A 2/1995 Ridgeway
5,542,537 A 8/1996 Ford
5,669,506 A 9/1997 Lofgren et al.
5,678,695 A 10/1997 Ridgeway et al.
5,722,541 A 3/1998 Lofgren et al.
5,862,914 A 1/1999 Farison et al.
5,893,462 A 4/1999 Ridgeway
5,894,932 A 4/1999 Harding et al.
5,912,058 A 6/1999 Takahashi et al.
5,967,327 A * 10/1999 Jones ..... 206/583
5,975,307 A 11/1999 Harding et al.
6,006,917 A * 12/1999 Loeffler ..... 206/583
(Continued)

OTHER PUBLICATIONS

Milligan, All Wrapped Up, Ready to Prosper: Packaging: Transporting fragile goods becomes easier with inventor's system, Los Angeles Times, Jun. 26, 1990.

*Primary Examiner* — Luan K Bui
(74) *Attorney, Agent, or Firm* — Clayton, Howarth & Cannon, P.C.

(57) ABSTRACT

A packaging assembly is disclosed. The packaging assembly is easily assembled and disassembled for convenient use and provides suspension of an enclosed article by way of an arched structure providing protection from impact, shock and vibration.

21 Claims, 18 Drawing Sheets

U.S. PATENT DOCUMENTS

| | | | | |
|---|---|---|---|---|
| 6,010,006 | A | 1/2000 | Ridgeway et al. | |
| 6,073,761 | A | 6/2000 | Jones | |
| 6,148,590 | A | 11/2000 | Ridgeway et al. | |
| 6,148,591 | A | 11/2000 | Ridgeway et al. | |
| 6,170,659 | B1 | 1/2001 | Hunter | |
| 6,223,901 | B1 * | 5/2001 | Lofgren et al. | 206/583 |
| 6,289,655 | B1 | 9/2001 | Ridgeway et al. | |
| 6,302,274 | B1 | 10/2001 | Ridgeway | |
| 6,311,844 | B1 | 11/2001 | Ridgeway et al. | |
| 6,467,624 | B1 | 10/2002 | Lofgren et al. | |
| 6,648,134 | B2 | 11/2003 | Gordon et al. | |
| 6,675,973 | B1 | 1/2004 | McDonald et al. | |
| 6,817,161 | B1 | 11/2004 | Wu et al. | |
| 6,880,706 | B2 * | 4/2005 | Braconnot et al. | 206/583 |
| 6,899,229 | B2 | 5/2005 | Dennison et al. | |
| 6,913,147 | B2 | 7/2005 | Mueller et al. | |
| 6,920,981 | B2 | 7/2005 | Lofgren et al. | |
| 6,942,101 | B2 | 9/2005 | Lofgren et al. | |
| 7,086,534 | B2 | 8/2006 | Roesel et al. | |
| 7,150,356 | B2 | 12/2006 | Lofgren et al. | |
| 7,290,662 | B2 | 11/2007 | Lofgren et al. | |
| 7,296,681 | B2 | 11/2007 | McDonald et al. | |
| 7,299,926 | B2 | 11/2007 | Russell et al. | |
| 2002/0144926 | A1 | 10/2002 | Rutledge | |
| 2007/0051652 | A1 * | 3/2007 | Tilton | 206/462 |
| 2008/0029419 | A1 * | 2/2008 | Appelbaum | 206/463 |
| 2010/0031868 | A1 | 2/2010 | Suda et al. | |

* cited by examiner

SYSTEM AND METHOD OF PACKAGING

CROSS-REFERENCE TO RELATED APPLICATIONS

This application is a continuation of U.S. application Ser. No. 12/359,944, filed Jan. 26, 2009, now abandoned which claims the benefit of U.S. Provisional Application No. 61/023,396, filed Jan. 24, 2008, which are hereby incorporated by reference herein in their entireties, including but not limited to those portions that specifically appear hereinafter, the incorporation by reference being made with the following exception: In the event that any portion of the above-referenced applications is inconsistent with this application, this application supercedes said above-referenced applications.

STATEMENT REGARDING FEDERALLY SPONSORED RESEARCH OR DEVELOPMENT

Not Applicable.

BACKGROUND

1. The Field of the Disclosure

The present disclosure is directed to a packaging system and method. In particular, the disclosure is directed to a suspension packaging system and method that includes an arched suspension member and a retention member for holding an article.

2. Description of the Related Art

Protective packaging devices are often used to protect articles from shocks and impacts during storage, shipping or transportation. For example, when transporting articles such as electronics, it is often desirable to cushion the article inside a container to protect the article from a physical impact that may occur to the container that can occur during transit and/or display in a retail environment. In particular, when shipping sensitive articles such as computer components, it is often desirable to protect those components from dust and dirt and even moisture.

In most cases, some additional structure is used inside of a shipping container to keep the article from moving uncontrollably inside the container and thus preventing damage. Such additional structures, long available, include paper or plastic packing material, structured plastic foams, and foam-filled cushions, and the like. Ideally, the article to be packaged is spaced away from the walls defining the container, thus protecting the article from damage due to foreign objects which may impact or compromise the outer walls of the container.

SUMMARY OF THE DISCLOSURE

One aspect of at least one of the illustrative embodiments disclosed herein includes the realization that arch structure of material can be configured to provide both a positioning and a suspending function within the container defining a cavity. This particular aspect provides several advantages over the available art. For example, by forming such a device out of generally planar materials, the device can be transported and stored in an unfolded and flat state as a single piece, thereby simplifying the storage, transportation, and use of the devices in accordance with the present disclosure.

For example, a packaging system using a somewhat bulky material, such as foam, is overly cumbersome and costly. Bulky packaging is costly to store because it takes up relatively large amounts of potentially costly warehouse space.

Further, bulky packaging is cumbersome to move and generally takes up more resources than its value would warrant. Thus, by constructing the packaging system from a planar material that can be left in a flat, compact configuration until it is needed, results in much more efficient storage space utilization.

In accordance with one illustrative embodiment of the present disclosure, a packaging assembly for packaging an article and maintaining the article in a position spaced from a wall of a container, may comprise a resilient generally planar arched member comprising an arched portion and a first and second vertical portions disposed at opposite ends of the arched portion. A substantially rigid member comprises a container portion comprising a plurality of foldable portions configured to form at least a bottom and first, second, third, and fourth walls extending from a periphery of the bottom.

In accordance with another illustrative embodiment of the present disclosure, a packaging container for packaging an article and maintaining the article in a position spaced from a wall of the container comprises a planar resilient member comprising an arched portion with a first and second vertical portions disposed at opposite ends of the arched portion. A substantially rigid member comprises a container portion comprising a means for forming at least a bottom and first, second, third, and fourth walls extending from a periphery of the bottom. The container also includes means for securing an article to the arched member, wherein the means for securing is illustratively a membrane material is capable of deforming around an article to be secured.

In accordance with an additional illustrative embodiment of the present disclosure, a packaging container for packaging an article and maintaining the article in a position spaced from a wall of the container includes a planar resilient member comprising an arched portion with a first and second vertical portions disposed at opposite ends of the arched portion. A substantially rigid member comprises a container portion comprising a means for forming at least a bottom and first, second, third, and fourth walls extending from a periphery of the bottom. The container also includes means for securing an article to the arched member, wherein the means for securing is illustratively a planar membrane material capable of deforming around an article to be secured and is substantially the same size and shape as the planar resilient member.

In accordance with a further illustrative embodiment of the present disclosure, a packaging container for packaging an article and maintaining the article in a position spaced from a wall of the container includes a planar resilient member comprising an arched portion with a first and second vertical portions disposed at opposite ends of the arched portion. A substantially rigid member comprises a container portion comprising a means for forming at least a bottom and first, second, third, and fourth walls extending from a periphery of the bottom. The container also includes means for securing an article to the arched member, wherein the means for securing is illustratively a membrane material capable of deforming around an article to be attached, and a framing member having an opening corresponding to the article to be secured.

In accordance with an additional illustrative embodiment of the present disclosure, a packaging container for packaging an article and maintaining the article in a position spaced from a wall of the container comprises a planar resilient member comprising an arched portion with a first and second vertical portions disposed at opposite ends of the arched portion. A substantially rigid member comprises a container portion comprising a means for forming at least a bottom and first, second, third, and fourth walls extending from a periphery of the bottom. The container also includes means for securing an article to the arched member, wherein the means for securing is illustratively a membrane material capable of deforming around an article to be attached, and a framing member having a plurality of openings corresponding to a plurality of articles to be secured.

In accordance with still another illustrative embodiment of the present disclosure, a packaging container for packaging an article and maintaining the article in a position spaced from a wall of the container comprises a planar resilient member comprising an arched portion with a first and second vertical portions disposed at opposite ends of the arched portion. A substantially rigid member comprises a container portion comprising a means for forming at least a bottom and first, second, third, and fourth walls extending from a periphery of the bottom. The container also includes means for securing an article to the arched member, wherein the means for securing is illustratively a membrane material capable of deforming around an article to be attached, a framing member having an opening corresponding to the article to be secured, and further comprising a dampening member.

In accordance with a yet further illustrative embodiment of the present disclosure, a packaging container for packaging an article and maintaining the article in a position spaced from a wall of the container includes a planar resilient member comprising an arched portion with a first and second vertical portions disposed at opposite ends of the arched portion. A substantially rigid member comprises a container portion comprising a means for forming at least a bottom and first, second, third, and fourth walls extending from a periphery of the bottom. The container also includes means for securing an article to the arched member, wherein the means for securing is illustratively a membrane material capable of deforming around an article to be attached, a framing member having an opening corresponding to the article to be secured, and further comprising a dampening member disposed between the article and the arched portion.

In accordance with an additional illustrative embodiment of the present disclosure, a packaging container for packaging an article and maintaining the article in a position spaced from a wall of the container includes a planar resilient member comprising an arched portion with a first and second vertical portions disposed at opposite ends of the arched portion. A substantially rigid member comprising a container portion comprising a means for forming at least a bottom and first, second, third, and fourth walls extending from a periphery of the bottom. The container also includes means for securing an article to the arched member, wherein the means for securing is illustratively a membrane material capable of deforming around an article to be attached, a framing member having an opening corresponding to the article to be secured, and further comprising a planar dampening member having substantially the same size and shape as the planar resilient member disposed between the article and the securing means.

For purposes of summarizing the illustrative embodiments and the advantages achieved over the previously available structures, certain objects and advantages of the inventions have been described herein. It is within the scope of the disclosure that not necessarily all such objects or advantages may be achieved in accordance with any particular embodiment of the invention. Thus, for example, those skilled in the art will recognize that the invention may be embodied or carried out in a manner that achieves or optimizes one advantage or a group of advantages as taught herein without necessarily achieving other objects or advantages as may be taught or suggested herein.

All of the illustrative embodiments described in the present disclosure fall within the scope of the invention disclosed herein. These and other embodiments which fall within the scope of the claimed invention will become readily apparent to those skilled in the art from the following detailed description of the illustrative embodiments having reference to the attached figures, the invention not being limited to any particular embodiments disclosed herein. As used herein, arrows used at the ends of a lead line indicate the entire section toward which it points. As used herein, an arrow on a lead line touching a line, indicates the surface shown by the line looking along the direction of the arrow.

The features and advantages of the present disclosure will be set fourth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which:

FIG. 13*a* is a further exemplary embodiment of a packaging assembly in accordance with the present disclosure;

DETAILED DESCRIPTION

Figure 1:
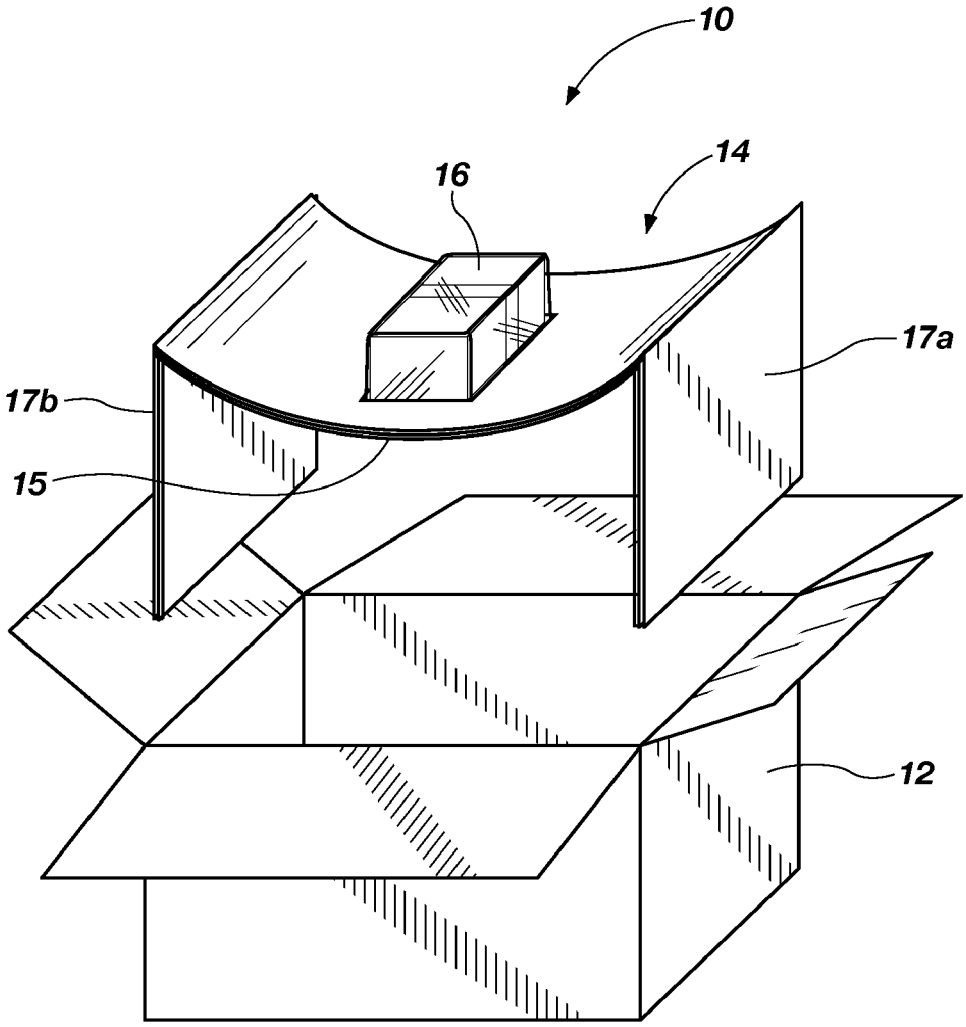
FIG. 1 is a perspective view of an illustrative embodiment of a package assembly.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise. In describing and claiming the present disclosure, the following terminology will be used in accordance with the definitions set out below. As used herein, the terms "comprising," "including," "containing," "characterized by," and grammatical equivalents thereof are inclusive or open-ended terms that do not exclude additional, unrecited elements or method processes.

Referring now to FIG. 1, there is shown an illustrative embodiment of a packaging assembly 10 in accordance with the principles of this disclosure. The packaging assembly 10 may provide a container 12 and an arched member 14 for suspending and positioning an article 16 within container 12. The arched member 14 may comprise an arched portion 15 and vertical portions 17*a* and 17*b* disposed on opposing ends of the arched portion 15. The arched member 14 also may suspend the article 16 away from the inside surfaces of the container 12.

The arched member 14 in the illustrated embodiment may be held in an arched state by the corresponding sides of the container 12. Alternatively, the arched portion 15 may be preformed so as to remain in an arched form without external force. Desirably, the arched portion 15 may be pre-tensioned for optimally suspending an article 16 in a predetermined manner to respond to anticipated loading. The vertical portions 17*a* & 17*b* may be sized to correspond to the corresponding dimension (e.g., vertical height) of container 12. The vertical portions 17*a* & 17*b* may also be fixedly attached to container 12, as can be determined by those skilled in the art, as well as the vertical portions 17*a* & 17*b* can be removably attached to container 12.

Figure 2:
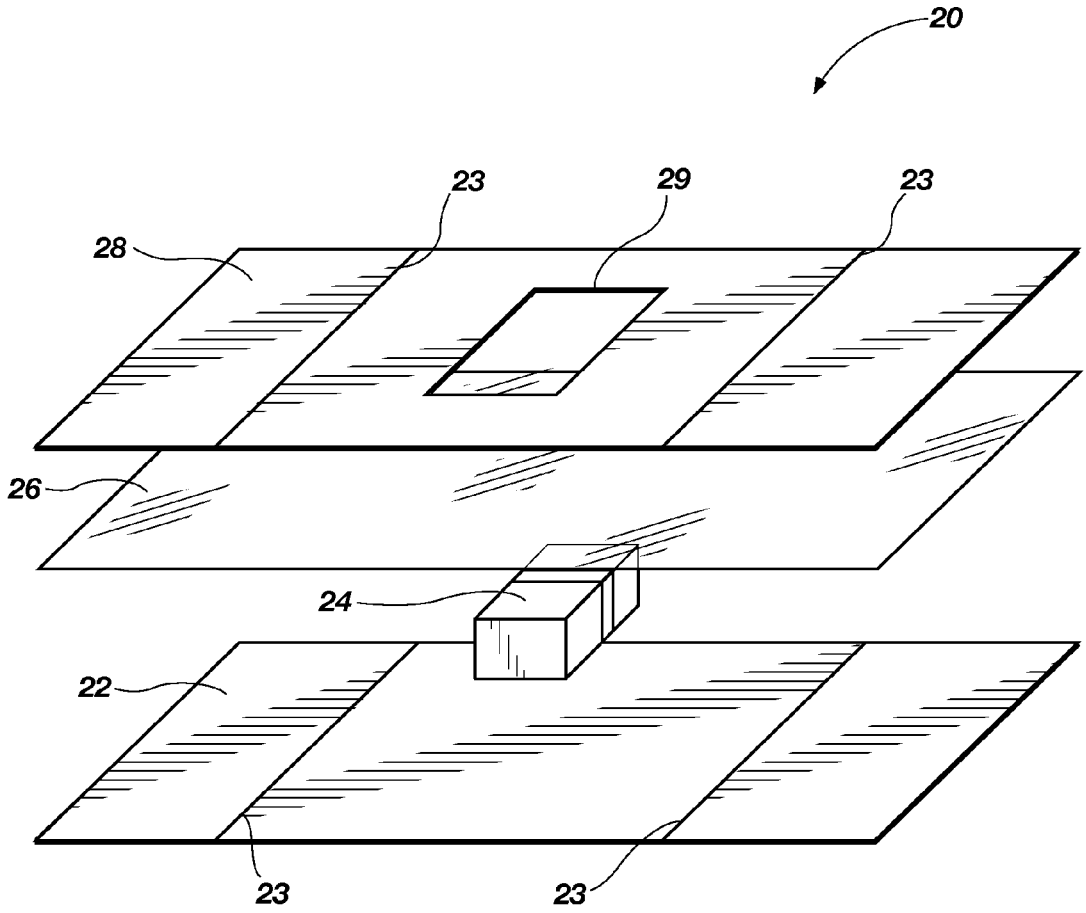
FIG. 2 is a perspective view of a packaging assembly in accordance with the present disclosure.

Referring now to FIG. 2, there is shown a perspective view of an exemplary embodiment of an unassembled packaging assembly 20. The packaging assembly 20 may comprise a resilient member 22, a retention member 26 and a framing member 28. The article 24 to be packaged is shown in the relative relationship it may typically be placed, such that as the assembly 20 is assembled by bringing resilient member 22 into contact with framing member 28, article 24 forces retention member 26 to conform to its shape to the shape of the article 24 through opening 29 of the framing member 28. It will be appreciated that the resulting structure, as will be fully understood shortly, provides both a very secure packaging system as well as a very aesthetically pleasing presentation of the article to the person receiving the article.

Still referring to FIG. 2, the resilient member 22 may comprise fold lines 23 to direct folding along said line during assembly. The resilient member may be made from any suitable material or combination of materials. For example, the following materials may be selected by those skilled in the art in accordance with the present disclosure: paper, pulp, metal, polymer, copolymer, laminate, composite or fiber (including materials not already available which, when not already rigid are flexible and/or semi-rigid will bend without self scoring or creasing) as well as any polymer, copolymer, laminate, mesh or flexible film, including materials not already available with tear resistance, resilience, memory. The recited examples of materials are not intended to be limiting but rather exemplary of the myriad of possibilities. Very heavy articles to be contained may require a resilient member to be made of suitable materials such as a metal (e.g., structural steel) or a synthetic material (e.g., carbon fiber composite) to provide proper strength.

Still referring to FIG. 2, it should also be noted that the resilient member 22 may be constructed of several layers in order to fine tune its suspension and isolation properties, as will be fully described shortly. For example, there exist prohibitively expensive pre-made materials which can be used in accordance with the present disclosure. However, the present disclosure makes clear that effective suspension and dampening may be achieved using several layers of varying materials to adjust and tune the characteristics of the resilient member 22 to an optimum value in accordance with the application to which the structure is to be placed.

The framing member 28 may also be made from any suitable material or combination of materials. For example the following materials may be used; paper, pulp, metal, polymer, copolymer, laminate, composite or fiber (including materials not already available which, when not already rigid are flexible and/or semi-rigid will bend without self scoring or creasing), any polymer, copolymer, laminate, mesh or flexible film (including materials not already available with tear resistance, resilience, memory). These examples of materials are not intended to be limiting but rather merely exemplary of possibilities of materials options.

As indicated above in connection with resilient member 22, heavy objects may suggest a framing member 28 be made of suitable materials such as a metal (e.g., structural steel) or a synthetic material (e.g., carbon fiber composite) to provide proper strength. It should also be noted that the framing member 28 may be made of several layers in order to aid in fine tuning the suspension and isolation properties of the overall packaging. For example, proprietary corrugated products are costly to use. However, less expensive materials can be combined as separate components of the framing member 28 to approximate proprietary corrugated products.

Continuing to refer to FIG. 2, framing member 28 may also comprise an opening 29 therein. The opening 29 may be sized such that it corresponds to the article 24. The opening 29 may include complex shapes corresponding to the complex shapes of any article to be contained, such as the article 24. Desirably, the framing member 28 may have decorative elements provided thereon for improving further the aesthetic impression made during presentation of the article 24 to a recipient of the article. The framing member 28 may have instructions or article information printed thereon or decorative indicia placed thereon.

Figure 3:
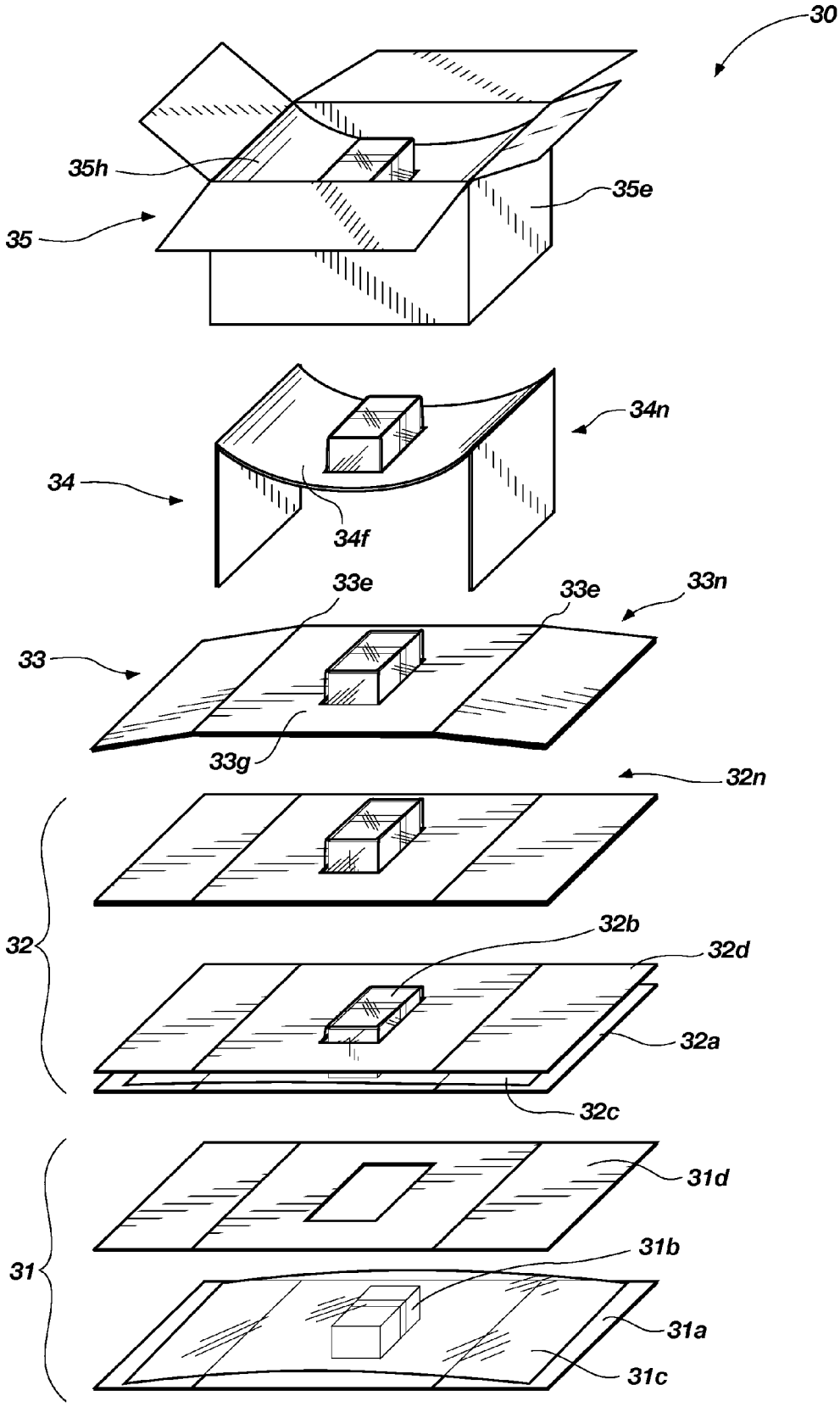
FIG. 3 is an embodiment illustrating a method for assembling a package assembly in accordance with the present disclosure.

Referring now to FIG. 3, there is represented an illustrative method of assembling a package assembly 30. The process represented by the structures indicated at bracket 31 illustrates the components of a packaging assembly having resilient member 31*a*, article 31*b*, retention member 31*c* and framing member 31*b* being readied for use. The process represented at bracket 31 comprises placing an article 31*b* onto the resilient member 31*a*. Next, the retention member 31*c* is laid over the article 31 a and the framing member 31*d* is then positioned over the retention member 31*c* such that an opening in the framing member 31*b* is positioned over the article 31*b*.

The process represented by the structures indicated at bracket 32 is illustrative of a process of compressing the components together. The process comprises aligning the opening in framing member 32*d* directly over article 32*b*, the framing member 32*d* is pressed toward the resilient member 32*a* until the members are substantially touching over a substantial part of there opposing faces. By pressing the members together article 32*b* protrudes though the opening in framing member 32*d*, thereby causing the deformation of the retention member 32*c*. The deformation of the retention member 32*c* is constrained by both to shape of the article 32*b* and the opening in 32*d*, thereby creating a pocket around the article 32*b*, holding it in place for suspension and display. When the components are pressed in place the result is a packaging assembly 32*n*. In the numbering in the figure, "n" is used to represent the combination of "a, b, c, and d."

In a process for forming the structure illustrated at bracket 33 the packaging assembly 32*n* is folded along fold lines 33*e* creating vertical portions in the packaging assembly 33*n* disposed on either end of the center portion 33*g*. The folds may be folded to 90 degrees, and it is also consistent with the disclosure to have angles greater or less than 90 degrees.

In a process for forming the structure illustrated at 34 an arching portion 34*f* is formed in packaging assembly 34*n*. The arch may be held in an arched state by the corresponding sides of the container (to be described shortly). The arch may also be preformed so as to remain in an arched form without external force. The arch may be pre-tensioned for optimally suspending in a predetermined manner to respond to anticipated loading.

In a process for forming the structure illustrated at 35 the packaging assembly 35*n* is placed into a container 35*e* forming package assembly 30. The container 35*e* may provide compressive force as an aid in holding the packaging assembly in an arched configuration. Other methods that interchange or slightly modify one or more processes are within the scope of this disclosure.

An embodiment of a method of making a packaging assembly may also comprise: fixedly attaching an article on a resilient member, folding an end portion of the resilient member at an angle relative to a portion of the resilient member, and forming an arched portion of the resilient member.

An embodiment of a method of making a packaging assembly may also comprise: fixedly attaching an article on a resilient member, folding an end portion of the resilient member at an angle relative to a portion of the resilient member, and forming an arched portion of the resilient member and providing a retention member configured to interface with the arched member.

An embodiment of a method of making a packaging assembly may comprise: fixedly attaching an article on a resilient member, folding an end portion of the resilient member at an angle relative to a portion of the resilient member, forming an arched portion of the resilient member and providing a retention member configured to interface with the arched member, and wherein the configuration is sized to substantially the same size as the arched member.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member, and said configuration is shaped to substantially the same shape as the arched member.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member and wherein said retention member is elastically deformed.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member and wherein said retention member is plastically deformed.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member and attaching said retention member to said arched member with adhesive.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member, attaching said retention member to said arched member with adhesive and wherein said retention member is deformed by pressing a frame member thereon.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member and wherein said retention member is plastically deformed, and wherein said retention member is deformed by pressing a frame member thereon.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member and further comprising providing a frame member having an opening.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member and further comprising providing a frame member having a plurality of openings.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member and further comprising providing a frame member having an opening.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member and further comprising providing a frame member having a plurality of openings.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member, providing a frame member having a plurality of openings and wherein said frame member has substantially the same perimeter shape as the arched member.

An embodiment of a method of making a packaging assembly may comprise: fixedly attaching an article on a resilient member, folding an end portion of the resilient member at an angle relative to a portion of the resilient member, and forming an arched portion of the resilient member and providing a retention member configured to interface with the arched member and further comprising providing a frame member having a plurality of openings, and wherein said frame member has substantially the same perimeter shape as the arched member.

Figure 4:
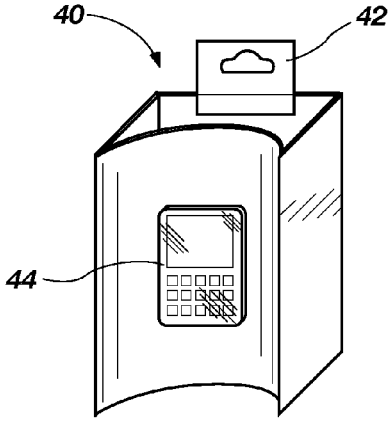
FIG. 4 is an exemplary embodiment of a packaging assembly in accordance with the present disclosure.

Referring now to FIG. 4 an illustrative embodiment of a packaging assembly 40 in accordance with the present disclosure is represented. The packaging assembly 40 may provide features to aid in display such as a hang tag 42 for hanging in commonly used display structures. The packaging assembly 40 may desirably be the primary packaging of an article 44. The primary packaging of an article would be a packaging assembly 40 that holds the article 44 for display absent or naked of any other packaging. For example, the packaging assembly 40 may be fabricated from clear materials such that the article 44 can be readily viewed within the package.

Figure 5:
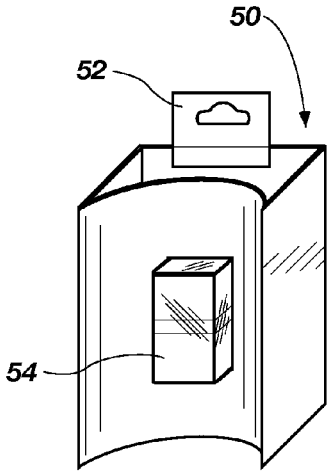
FIG. 5 is another exemplary embodiment of a packaging assembly in accordance with the present disclosure.

Referring next to FIG. 5, an illustrative embodiment of a packaging assembly 50 is represented. The packaging assembly 50 may provide features to aid in display such as a hang tag 52 for hanging in commonly used displays. A packaging assembly 50 may be the secondary packaging of an article 54. A secondarily packaged article would come in its own proprietary packaging and would then be secondarily packaged within a packaging assembly 50.

Figure 6:
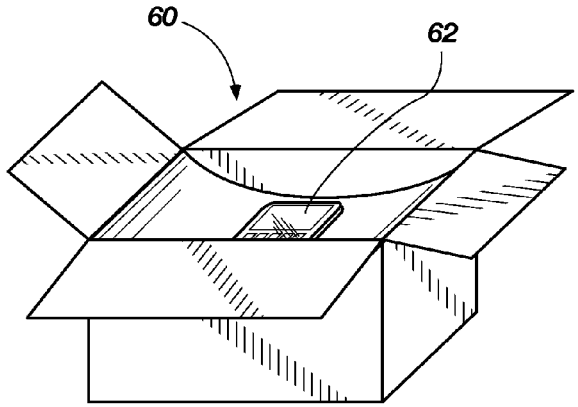
FIG. 6 is another exemplary embodiment of a package assembly in accordance with the present disclosure.

Referring to FIG. 6, an illustrative embodiment of a package assembly 60 in accordance with the present disclosure is represented. The package assembly 60 may provide features to aid in display and presentation of an article 62 as primary packaging within a container. The package assembly 60 as seen in FIG. 6 would desirably provide a centered and upright article upon opening the package. Aside from aiding in the presentation aspect of the article 62 the package assembly 60 would suspend the article within the surrounding container. It will be appreciated that the package assembly 60 can be structured in accordance with those structures represented in FIGS. 1-3.

Figure 7:
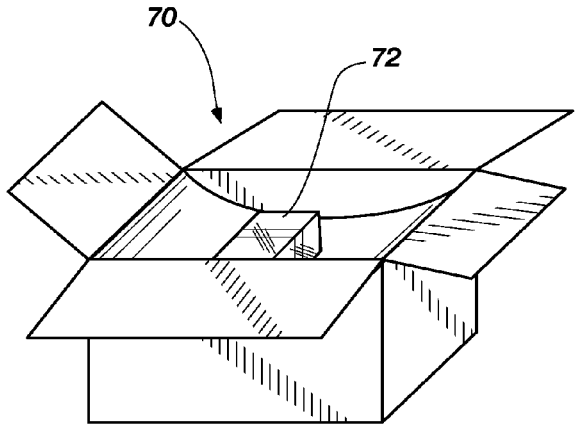
FIG. 7 is another exemplary embodiment of a package assembly in accordance with the present disclosure.

Referring to FIG. 7, an illustrative embodiment of a package assembly 70 is represented. The package assembly 70 may provide features to aid in display and presentation of an article 72 as secondary packaging within a container. A package assembly 70, as seen in FIG. 7, would provide a centered and upright primary packaged article upon opening the package. In addition to aiding in the presentation of the article 72, the package assembly 70 would suspend the article in the container for protection. It will be appreciated that the package assembly 70 can be structured in accordance with those structures represented in FIGS. 1-3.

Figure 8:
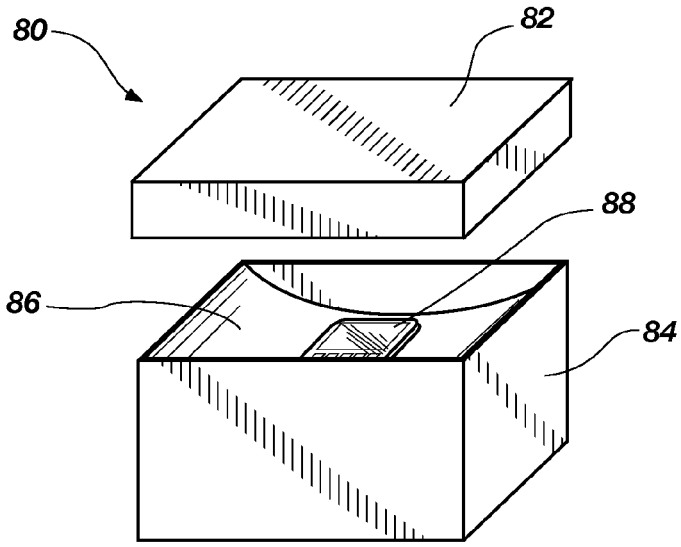
FIG. 8 is another exemplary embodiment of a package assembly in accordance with the present disclosure.

Referring to FIG. 8, an illustrative embodiment of a package assembly 80 is represented. The package assembly 80 may particularly be used in a gift box arrangement having a lid 82, container 84 and a packaging assembly 86. Package assembly 86 may provide features to aid in display and presentation of an article 88 as primary packaging within a gift box. The packaging assembly 86 as seen in FIG. 8 provides a centered and upright article 88 upon opening of the gift box. Aside from aiding in the presentation aspect of the article 88, the packaging assembly suspends the article within the container 84 for protection of the article 88. It will be appreciated that the packaging assembly 86 can be structured in accordance with those structures represented in FIGS. 1-3 and that decorative and informative indicia can be added to the structures appropriate to the gift occasion.

Figure 9:
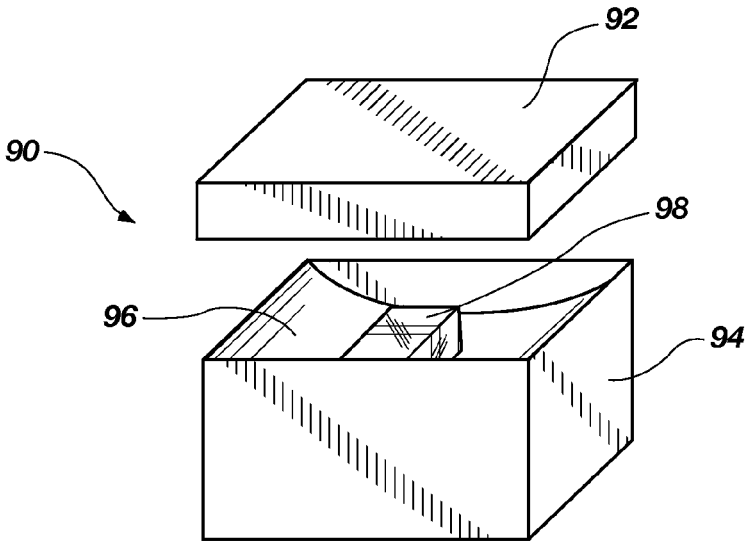
FIG. 9 is another exemplary embodiment of a package assembly in accordance with the present disclosure.

Referring next to FIG. 9, an illustrative embodiment of a package assembly 90 is represented. A package assembly 90 may be used in a gift box arrangement having a lid 92, container 94 and a packaging assembly 96. Packaging assembly 96 may provide features to aid in display and presentation of an article 98 as secondary packaging within a gift box. A packaging assembly 96 as seen in FIG. 9 provides a centered and upright packaged article upon opening the gift box. In addition to aiding in the presentation aspect of the article 98, the packaging assembly 96 would suspend the packaged article within the container 94 for protection. It will be appreciated that the packaging assembly 96 can be structured in accordance with those structures represented in FIGS. 1-3 and that decorative and informative indicia can be added to the structures appropriate to the gift occasion.

Figure 10:
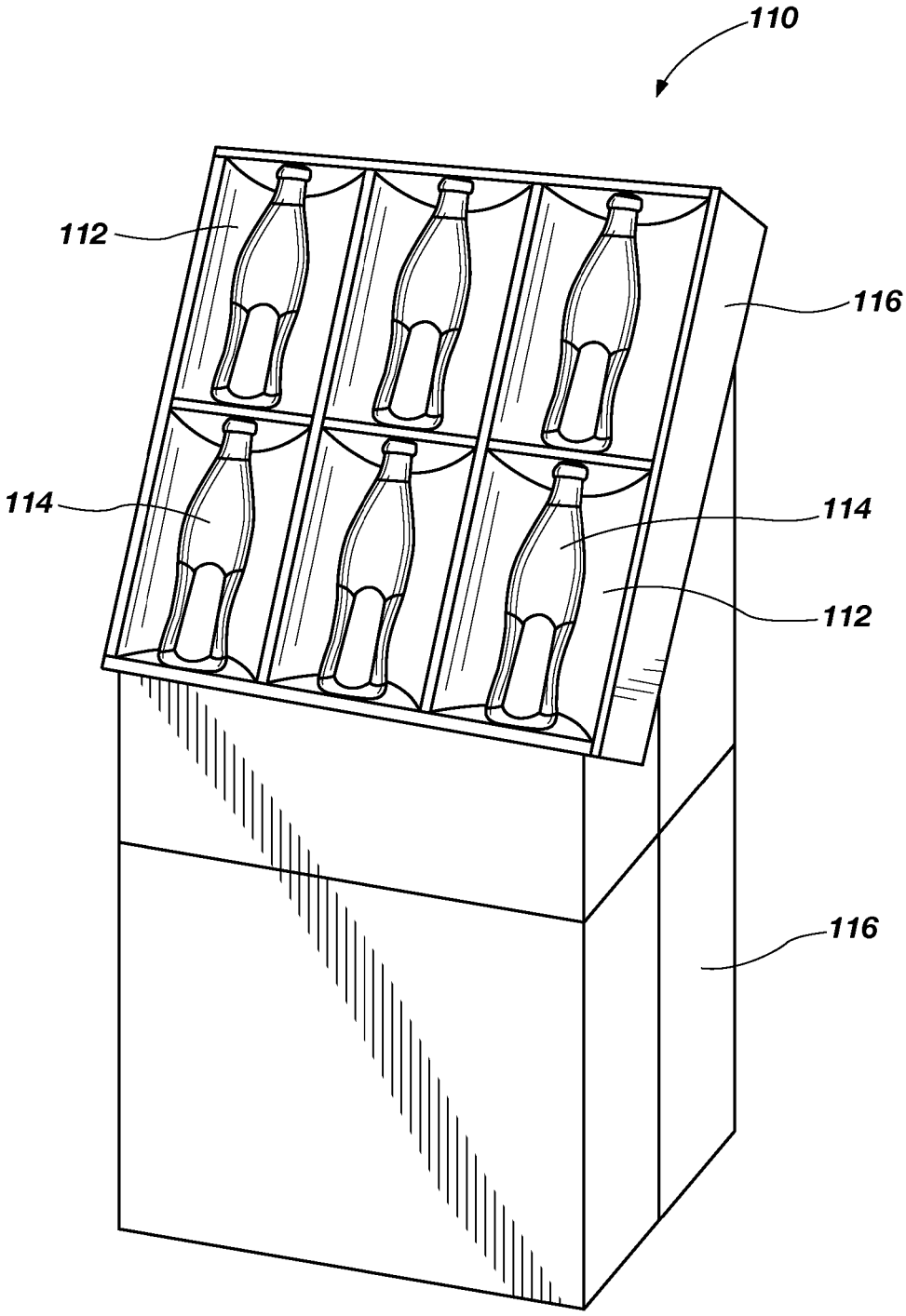
FIG. 10 is another exemplary embodiment of a packaging assembly in accordance with the present disclosure.

Referring to FIG. 10, an illustrative embodiment of a retail display 110 utilizing a packaging assembly 112 is represented. In a retail environment, the packaging assembly 112 may be used to attractively display articles 114. The retail display 110 may be constructed from original package assemblies 116. The package assembly 116 may contain structures and features that enable them to be stacked or combined in a way that promotes retail display. For example, package assembly 116 may include a feature of having a removable portion for displaying the contents thereof.

Figure 11:
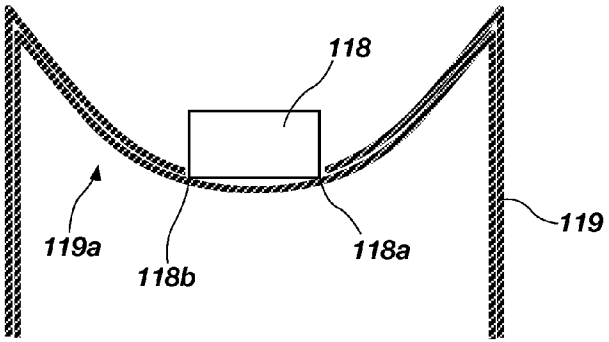
FIG. 11 is yet another exemplary embodiment of a packaging assembly in accordance with the present disclosure.

Referring now to FIG. 11, a cutaway side view of an illustrative embodiment of a packaging assembly 119 is provided. The packaging assembly 119 has an arched portion 119*a* which is in contact with the article 118. Where the arched portion 119*a* makes contact with the article 118, there are contact points 118*a*, 118*b*. The arched portion dampens and absorbs forces over the length of the arch, thereby protecting the article 118.

Figure 12:
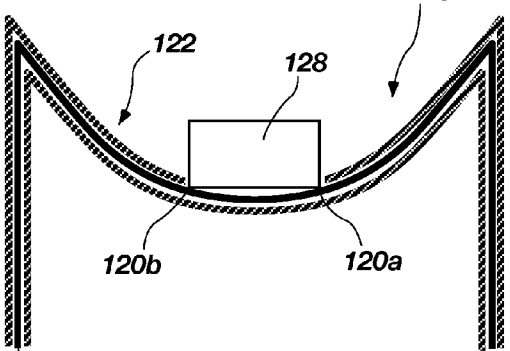
FIG. 12 is still another exemplary embodiment of a packaging assembly in accordance with the present disclosure.

Referring now to FIG. 12, a cutaway side view of another illustrative embodiment of a packaging assembly 120 is illustrated. The packaging assembly 120 has an arched portion 122 that is in contact with the article 128. The arched portion 122 dampens and absorbs forces over the length of the arch, thereby protecting the article 128. Further dampening and protection may be achieved with the addition of an adsorption member 125. The absorption member 125 makes contact with the article 128 at the contact points 120*a*, 120*b*, instead of the arched portion 122, thereby dampening forces, including shock and vibration, that are not dampened by the arch portion 122. The absorption member 125 may additionally act between the members converting shock and vibration forces into friction, further reducing the forces that reach the article 128. Those skilled in the art will be able to select a single layer of material, or multiple layers of the same or differing materials, from which to fabricate the absorption member 125 in accordance with the present disclosure.

Referring now to FIG. 13*a*, a cutaway side view of an illustrative embodiment of a packaging assembly 130 is provided. The packaging assembly 130 has an arched portion 132 that is in contact with the article 133. The arched portion 132 dampens and absorbs forces over the length of the arch, thereby protecting the article 133. Further dampening of forces may be achieved with the addition of an absorption member 134. The absorption member 134 makes contact with the article 128 at the contact point 131, instead of the arched portion 132, thereby absorbing and dampening additional forces that are not dampened by the arch portion 132. The absorption member 134 may additionally act between the members converting shock and vibration forces into friction, further reducing the forces that reach the article 133. As described above in connection with absorption member 125, those skilled in the art will be able to select a single layer of material, or multiple layers of the same or differing materials, from which to fabricate the absorption member 134 in accordance with the present disclosure.

Figure 13B:
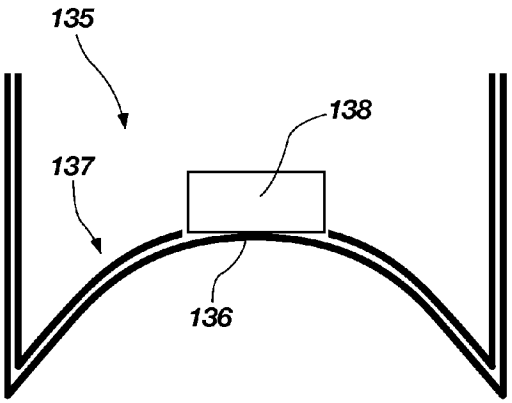
FIG. 13*b* is a yet further exemplary embodiment of a packaging assembly in accordance with the present disclosure.
Figure 13B:
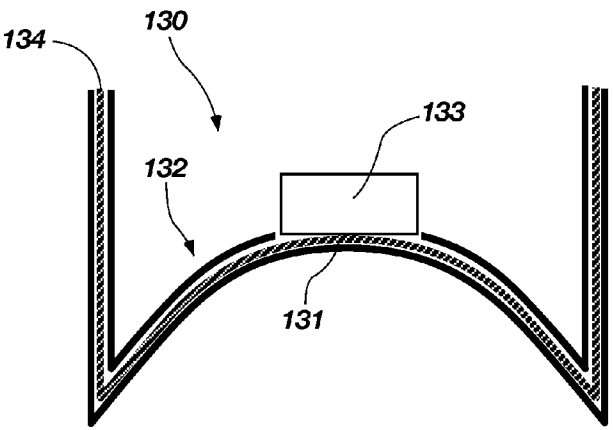

Referring now to FIG. 13*b*, a cutaway side view of an illustrative embodiment of a packaging assembly 135 is provided. The packaging assembly 135 has an arched portion 137 that is in contact with the article 138. Where the arched portion 137 makes contact with the article 138 there is a contact point 136. The arched portion 137 dampens and absorbs forces over the length of the arch, thereby protecting the article 138.

An embodiment of a packaging assembly may comprise: an arched member, vertical portions disposed on opposing ends of said arched member, and wherein said arched member provides suspension.

An embodiment of a packaging assembly may comprise: an arched member, vertical portions disposed on opposing ends of said arched member, and wherein said arched member provides suspension and may further comprise a retention member configured to interface with the arched member.

An embodiment of a packaging assembly may comprise: an arched member, vertical portions disposed on opposing ends of said arched member, and wherein said arched member provides suspension and may further comprise a retention member configured to interface with the arched member wherein said configuration is sized to substantially the same size as the arched member.

An embodiment of a packaging assembly may comprise: an arched member, vertical portions disposed on opposing ends of said arched member, and wherein said arched member provides suspension and may further comprise a retention member configured to interface with the arched member wherein said configuration is shaped to substantially the same shape as the arched member.

An embodiment of a packaging assembly may comprise: an arched member, vertical portions disposed on opposing ends of said arched member, and wherein said arched member provides suspension and may further comprise a retention member configured to interface with the arched member wherein said retention member is elastically deformed.

An embodiment of a packaging assembly may comprise: an arched member, vertical portions disposed on opposing ends of said arched member, and wherein said arched member provides suspension and may further comprise a retention member configured to interface with the arched member wherein said retention member is plastically deformed.

An embodiment of a packaging assembly may comprise: an arched member, vertical portions disposed on opposing ends of said arched member, and wherein said arched member provides suspension and may further comprise a retention member configured to interface with the arched member wherein said retention member is attached to said arched member with adhesive.

An embodiment of a packaging assembly may comprise: an arched member, vertical portions disposed on opposing ends of said arched member, and wherein said arched member provides suspension and may further comprise a retention member configured to interface with the arched member wherein said retention member is elastically deformed and wherein said retention member is deformed by a frame member.

An embodiment of a packaging assembly may comprise: an arched member, vertical portions disposed on opposing ends of said arched member, and wherein said arched member provides suspension and may further comprise a retention member configured to interface with the arched member wherein said retention member is elastically deformed and wherein said retention member is deformed by a frame member.

An embodiment of a packaging assembly may comprise: an arched member, vertical portions disposed on opposing ends of said arched member, and wherein said arched member provides suspension and may further comprise a retention member configured to interface with the arched member and may further comprise a frame member having an opening.

An embodiment of a packaging assembly may comprise: an arched member, vertical portions disposed on opposing ends of said arched member, and wherein said arched member provides suspension and may further comprise a retention member configured to interface with the arched member, and may further comprise a frame member having a plurality of openings.

An embodiment of a packaging assembly may comprise: an arched member, vertical portions disposed on opposing ends of said arched member, and wherein said arched member provides suspension and may further comprise a retention member configured to interface with the arched member and may further comprise a frame member having an opening.

An embodiment of a packaging assembly may comprise: an arched member, vertical portions disposed on opposing ends of said arched member, and wherein said arched member provides suspension and may further comprise a retention member configured to interface with the arched member and may further comprise a frame member having a plurality of openings.

An embodiment of a packaging assembly may comprise: an arched member, vertical portions disposed on opposing ends of said arched member, and wherein said arched member provides suspension and may further comprise a retention member configured to interface with the arched member and may further comprise a frame member having an opening wherein the frame member has substantially the same perimeter shape as the arched member.

An embodiment of a packaging assembly may comprise: an arched member, vertical portions disposed on opposing ends of said arched member, and wherein said arched member provides suspension and may further comprise a retention member configured to interface with the arched member and may further comprise a frame member having a plurality of openings and having substantially the same perimeter shape as the arched member.

Figure 14:
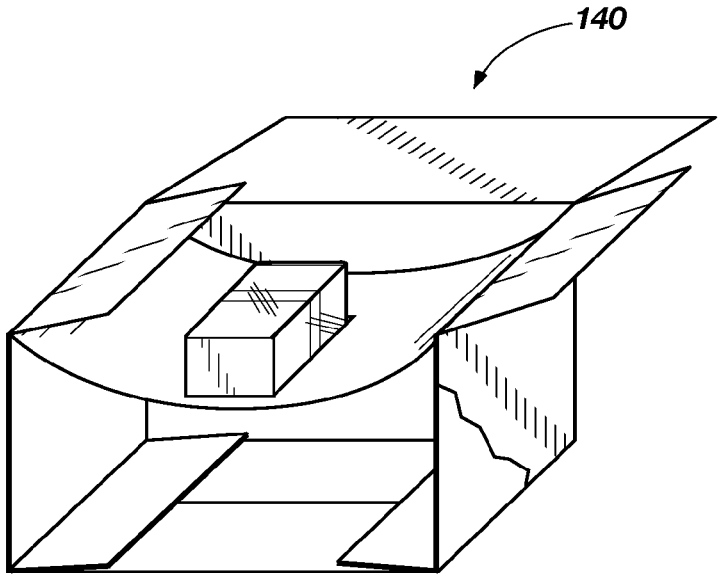
FIG. 14 is an exemplary embodiment of a package assembly in accordance with the present disclosure.

Referring now to FIG. 14, there is shown an illustrative embodiment of a package assembly 140. The cutaway view illustrates how the package assembly 140 suspends the article in the interior of the container away from the walls of the container which are susceptible to collapse due to an impact from a force imposed from outside of the container. The container shown in FIG. 14 is that of a customary shipping box with flaps for closing.

Figure 15:
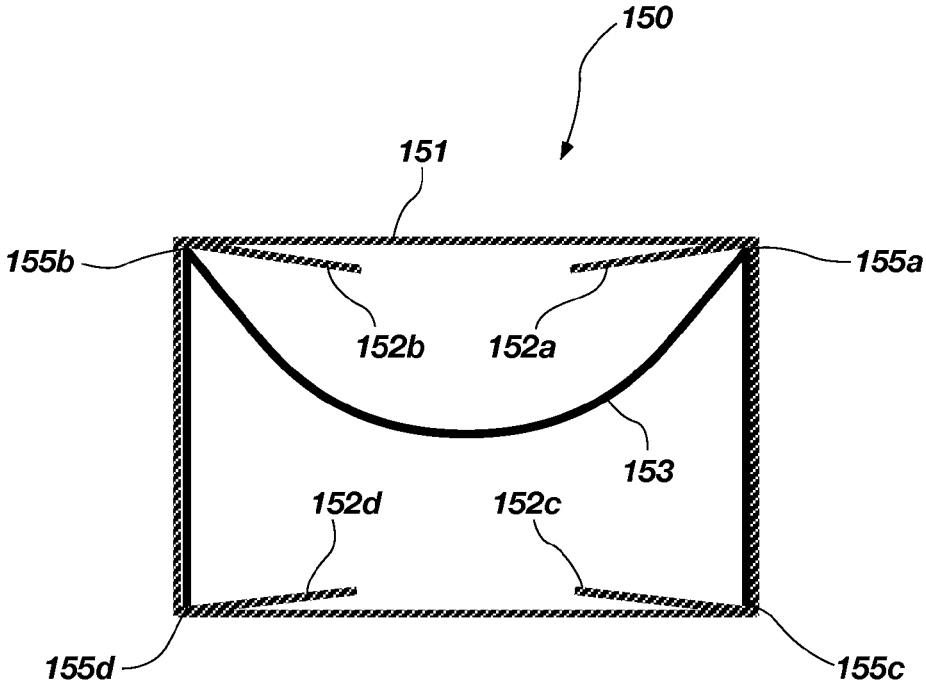
FIG. 15 is an exemplary embodiment of a package assembly in accordance with the present disclosure.

Referring now to FIG. 15, there is shown an illustrative embodiment of a package assembly 150 in cutaway side view. The package assembly 150 may comprise a container 151 having flaps 152*a*, 152*b*, 152*c*, and 152*d*, and a packaging assembly 153 disposed within the container 151. The packaging assembly may contact the container at contact points 155*a*, 155*b*, 155*c*, and 155*d*. Points corresponding to the contact points 155*a*, 155*b*, 155*c*, and 155*d* on the packaging assembly may move kinematically when forces are encountered and may make the suspension less effective within the package assembly 150. By affixing the packaging assembly at certain points there is a reduction in the degrees of freedom for all remaining points within the packaging assembly. By reducing the degrees of freedom within any system makes the system more predictable and therefore more effective for a targeted task. Flaps 152*a*, 152*b*, 152*c*, and 152*d*provide a locking or affixing means at points 155*a*, 155*b*, 155*c*, and 155*d*, by impeding the kinematic path of the points 155*a*, 155*b*, 155*c*, and 155*d* and thereby providing more effective suspension for a given article.

Figure 16:
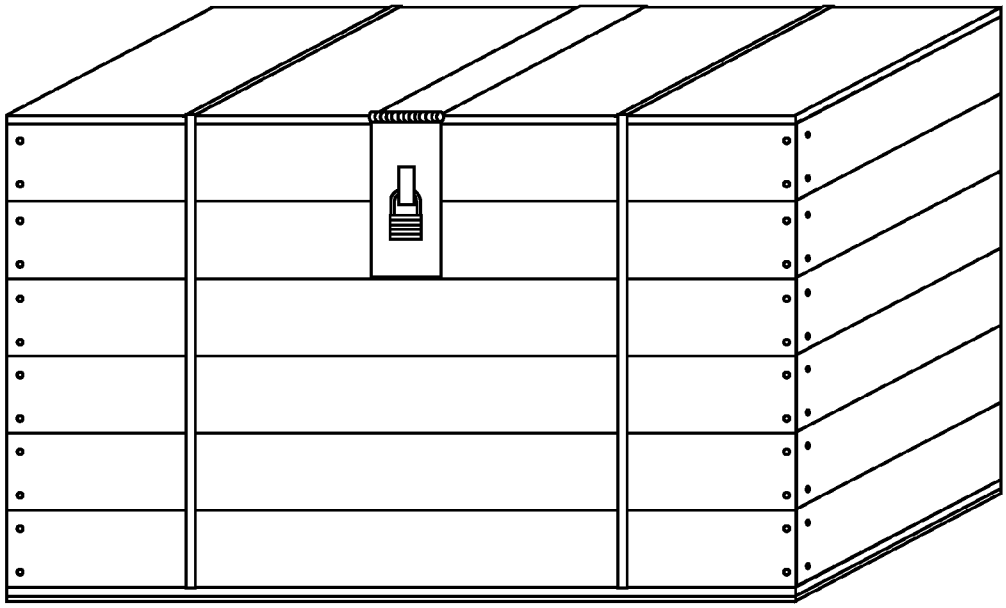
FIG. 16 is an exemplary embodiment of a package assembly particularly adapted for large and/or heavy articles in accordance with the present disclosure.

Referring now to FIG. 16, there is shown an illustrative embodiment of a heavy duty package assembly 160. The perspective view illustrates a structure capable of accepting hardware and mechanical and chemical fastening mechanisms and is particularly adapted for storing and shipping large and/or heavy articles.

Figure 17:
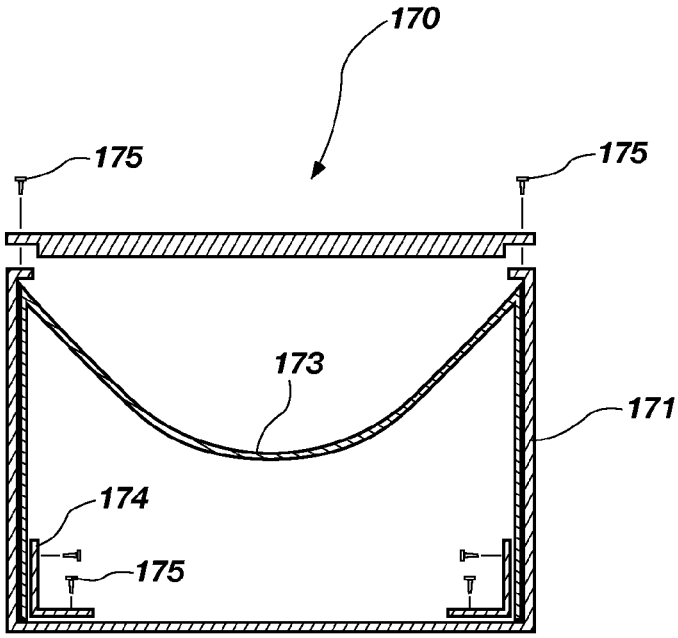
FIG. 17 is another exemplary embodiment of a package assembly particularly adapted for large and/or heavy articles in accordance with the present disclosure.

Referring now to FIG. 17, there is shown an illustrative embodiment of a package assembly 170 in cutaway side view. The package assembly 170 may comprise a container 171 having a packaging assembly 173 disposed within the container 171. Points corresponding on the packaging assembly 173 may move kinematically when forces are encountered, and may make suspension less effective within the package assembly 170. By affixing the packaging assembly 173 at certain points there is a reduction in the degrees of freedom for all remaining points within the packaging assembly. By reducing the degrees of freedom within any system makes the system more predictable and therefore more effective for a targeted task. Mechanical fixtures 174 and fasteners 175 may provide a locking or an affixing means by impeding the kinematic path of the points and thereby providing more effective suspension in a targeted application. The container 171 can be fabricated from any suitable material with sturdy materials such as, without limitation, metal, wood, plastics and composites being usable.

Figure 18:
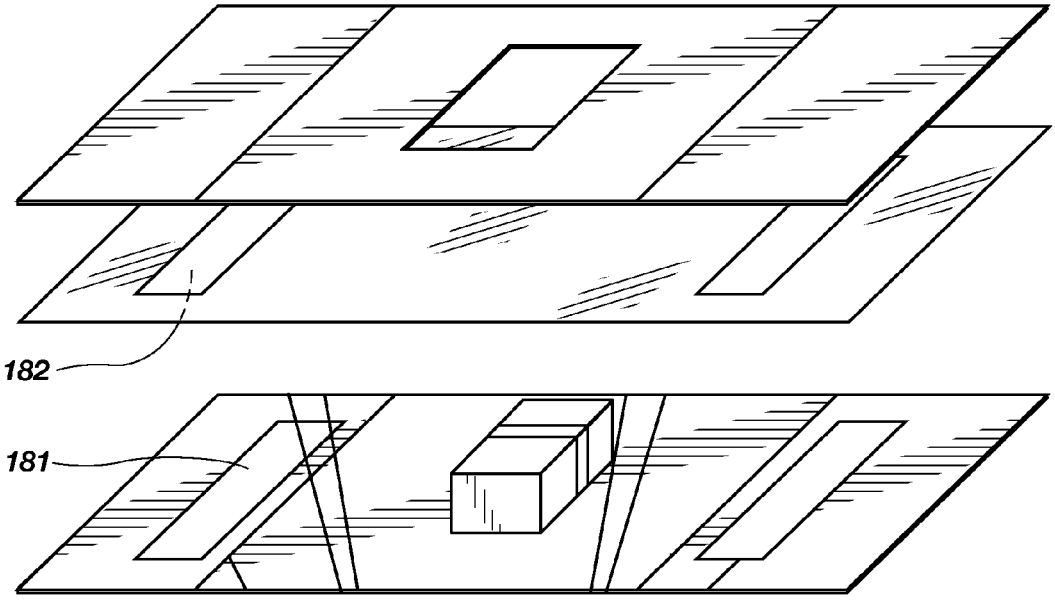
FIG. 18 is an exemplary embodiment of a packaging assembly which is positioned within a container in accordance with the present disclosure.

Referring now to FIG. 18, there is shown an illustrative embodiment of the separated components of a packaging assembly with adhesives 181 & 182 applied to various surfaces of the members. The adhesives 181 & 182 may provide additional means of fine tuning the suspension of the packaging assembly by locking predetermined members together thereby forcing the members to act together for a composite effect. The adhesives 181 & 182 can be any number of materials having adhesive properties, which can be selected and applied by those skilled in the art using the present disclosure.

Figure 19:
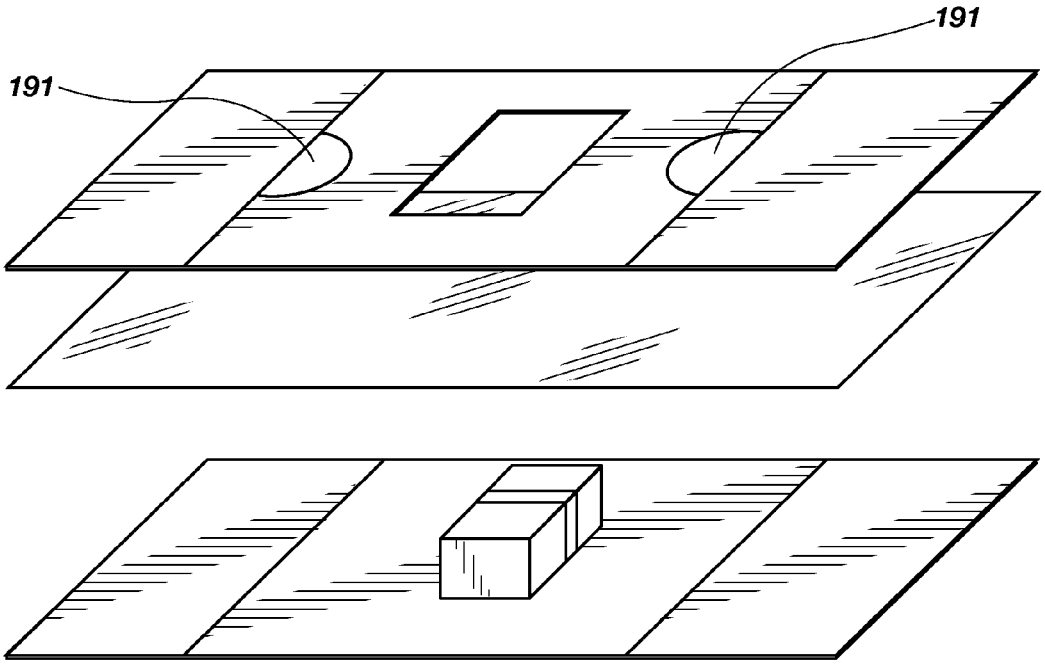
FIG. 19 is another exemplary embodiment of a packaging assembly which is positioned within a container in accordance with the present disclosure.
Figure 20:
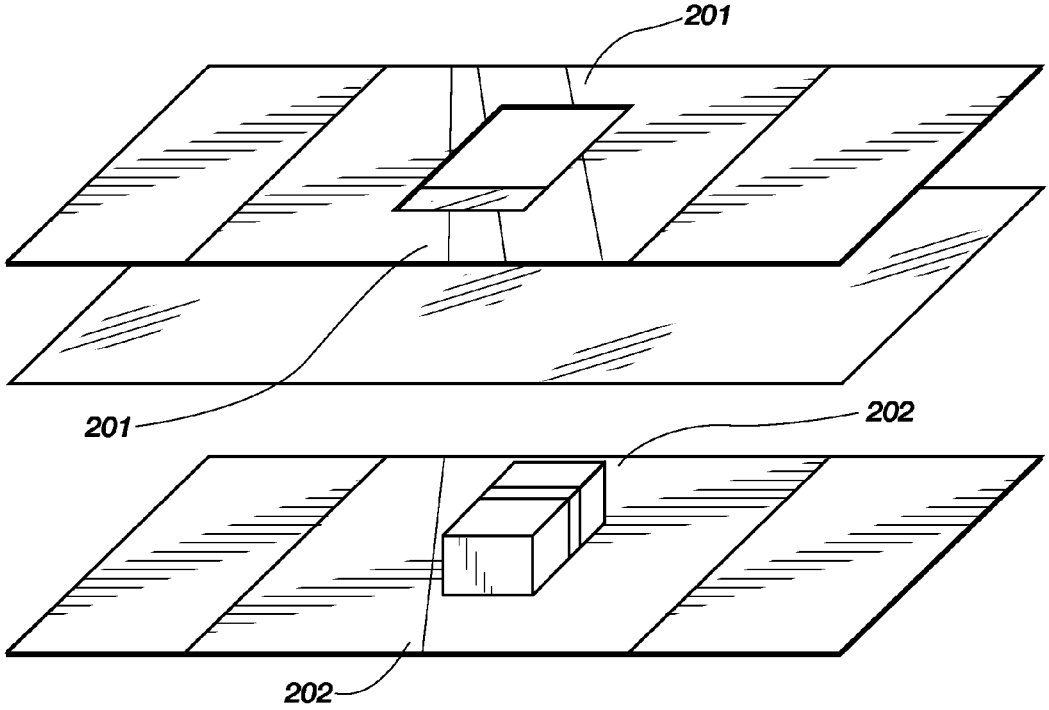
FIG. 20 is still another exemplary embodiment of a packaging assembly which is positioned within a container in accordance with the present disclosure.

Referring now to FIGS. 19 and 20, there are shown embodiments of assembly members having cutouts 191, 192, 201 & 201. The cutouts 191, 192, 201 & 202 may aid in accessing an article, by providing finger holds by which to remove the members, and thus the article, from a container. Additional means of accessing the articles may be tabs or loops provided on the members and are contemplated within the scope of the present disclosure.

Figure 21:
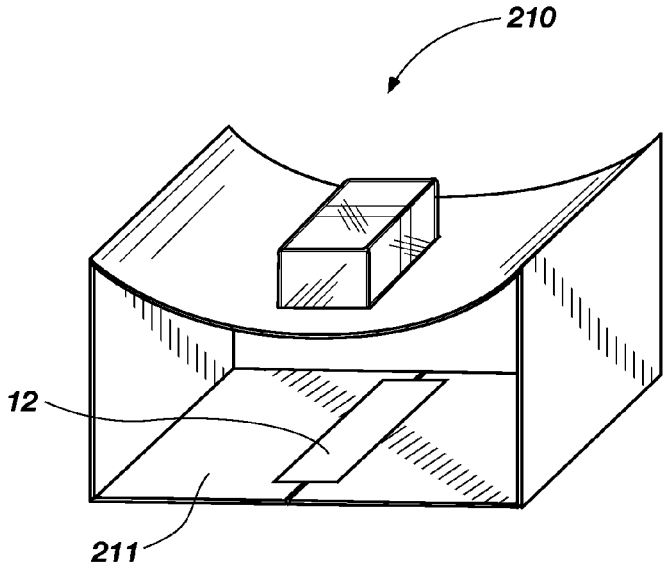
FIG. 21 represents an alternative exemplary embodiment of a packaging assembly which is positioned within a container in accordance with the present disclosure.

Referring now to FIG. 21, there is shown an illustrative embodiment of a packaging assembly 210 having bottom horizontal portions 211. In the embodiment of FIG. 21, a portion of adhesive tape 212 is provided for locking together the horizontal bottom portions 211 providing desirable packaging properties.

Figure 22:
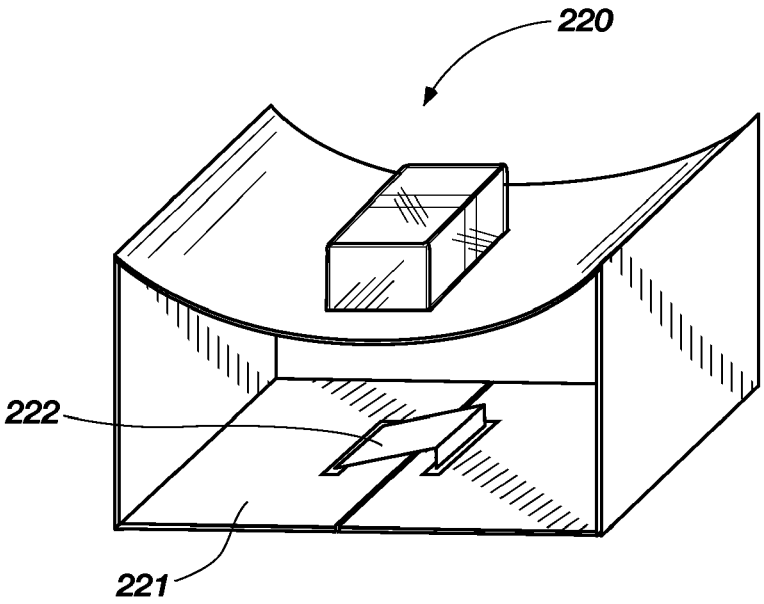
FIG. 22 represents another alternative exemplary embodiment of a packaging assembly which is positioned within a container in accordance with the present disclosure.

Referring now to FIG. 22, there is shown an illustrative embodiment of a packaging assembly 220 having bottom horizontal portions 221. In the embodiment of FIG. 22 a latch 222 is provided for locking together the bottom horizontal portions 221 providing desirable packaging properties.

Figure 23:
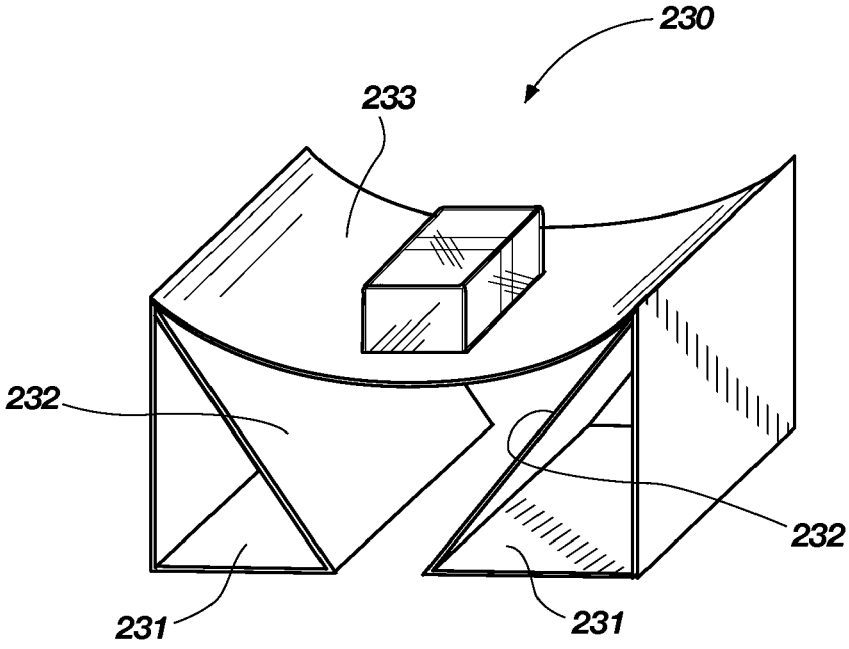
FIG. 23 represents a further alternative exemplary embodiment of a packaging assembly which is positioned within a container in accordance with the present disclosure.

Referring now to FIG. 23, there is shown an illustrative embodiment of a packaging assembly 230 having bottom horizontal portions 231. In the embodiment of FIG. 23 angled portions 232 connect a bottom portion to a corresponding end of an arched portion 233 providing desirable packaging properties.

Figure 24:
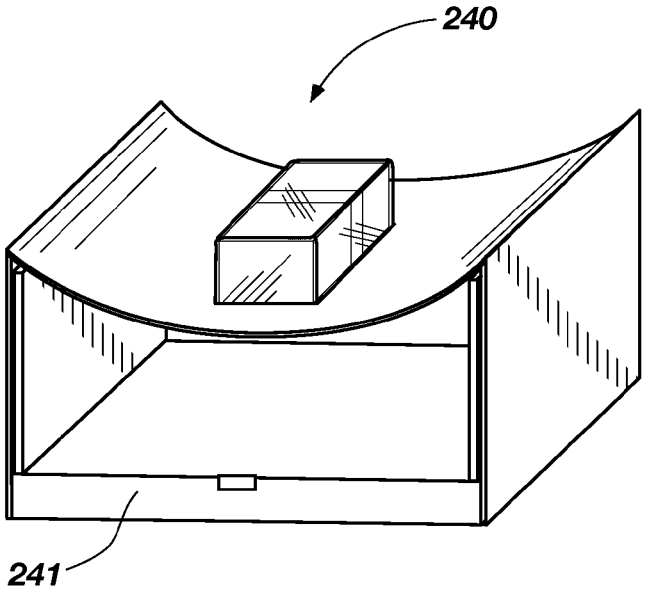
FIG. 24 represents still another alternative exemplary embodiment of a packaging assembly which is positioned within a container in accordance with the present disclosure.

Referring now to FIG. 24, there is shown an illustrative embodiment of a packaging assembly 240 having a storage area 241 or other type of compartment for accessories or non-suspended articles providing desirable packaging properties.

Figure 25:
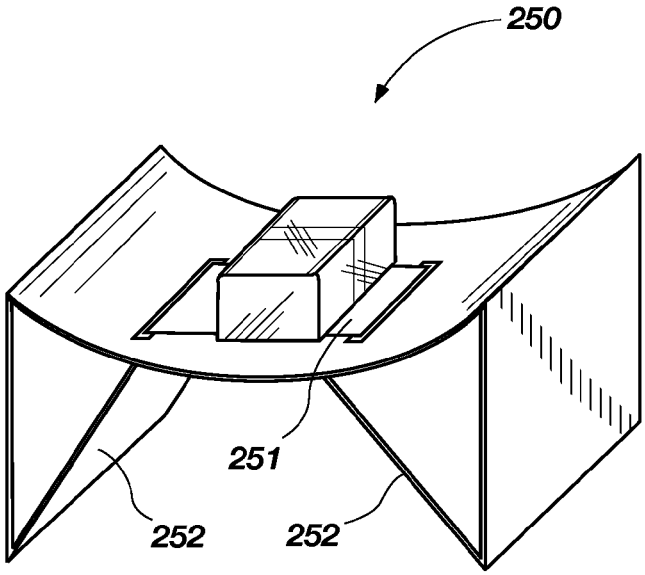
FIG. 25 represents a yet further alternative exemplary embodiment of a packaging assembly which is positioned within a container in accordance with the present disclosure.

Referring now to FIG. 25, there is shown an illustrative embodiment of a packaging assembly 250 having angled portions 252 with locking tabs 251 thereby providing additional means for determining the characteristics of the suspension providing desirable packaging properties.

Figure 26:
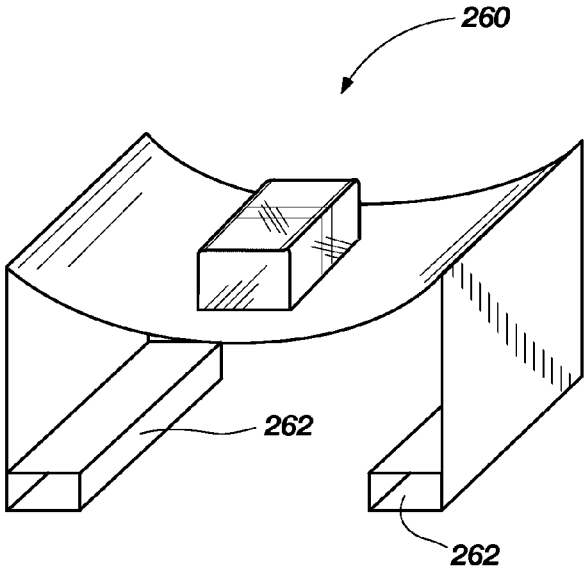
FIG. 26 represents an even further alternative exemplary embodiment of a packaging assembly which is positioned within a container in accordance with the present disclosure.

Referring now to FIG. 26, there is shown an illustrative embodiment of a packaging assembly 260 having structural beams 262 for providing structural integrity to the container and preventing lateral bending within the packaging assembly and providing desirable packaging properties.

Figure 27:
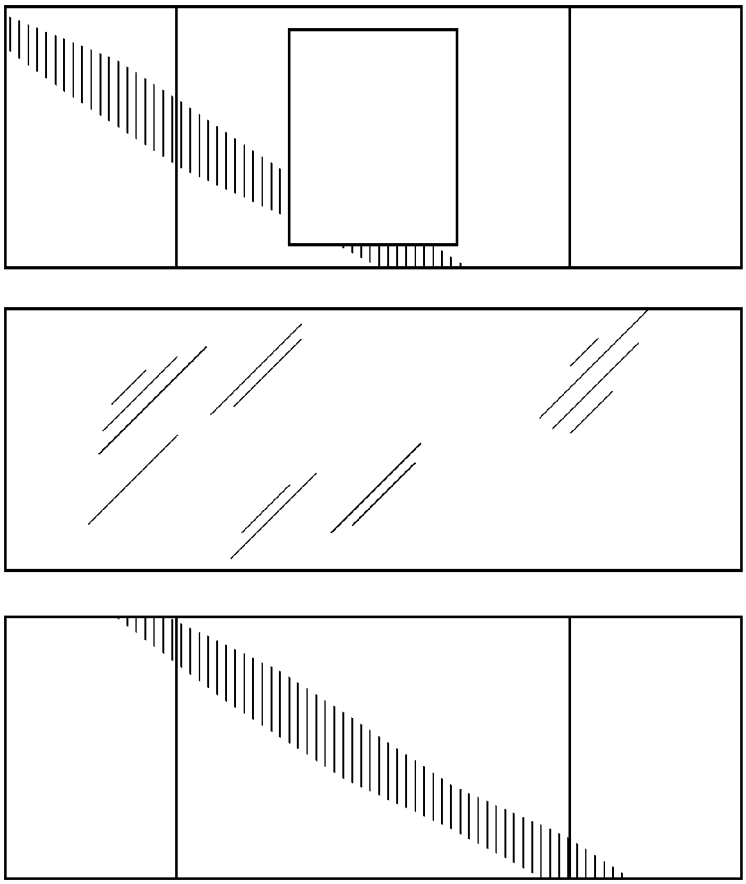
FIG. 27 is another exemplary embodiment of a packaging assembly in accordance with the present disclosure.

Referring now to FIG. 27, there is shown an illustrative embodiment of three packaging assembly members shown in plan view and arranged side-by-side for allowing comparison between the members. It can be seen from the size and shape of the packaging assembly members represented in FIG. 27 that the packaging assembly members can be readily stored in a flat and stacked relationship allowing for efficient use of the space used to store the members until they are needed for use, or reuse.

Figure 28A:
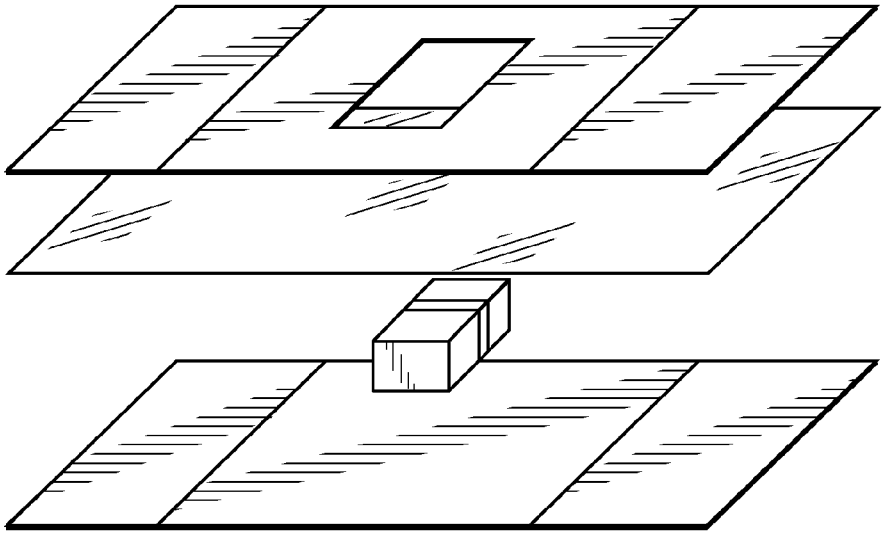
FIG. 28*a* is another exemplary embodiment of a packaging assembly in accordance with the present disclosure similarly structured to that represented in FIG. 27.

Referring now to FIG. 28*a*, there is shown an illustrative embodiment of packaging assembly members similar to those represented in FIG. 27 shown arranged ready for receiving an article to be safely stored and/or shipped.

Figure 28B:
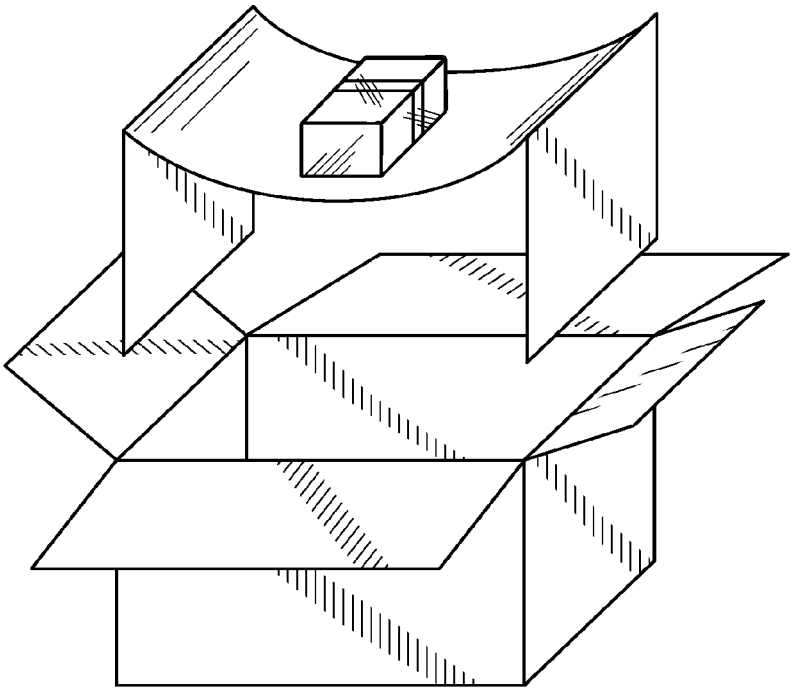
FIG. 28*b* is an exemplary embodiment of a packaging assembly in accordance with the present disclosure wherein structures similar to those represented in FIGS. 27-28 are installed in a container.

Referring now to FIG. 28*b*, there is shown an illustrative embodiment of the packaging assembly represented in FIG. 28*a* in an exploded view showing a typical fitment of structures inside of a container.

Figure 28C:
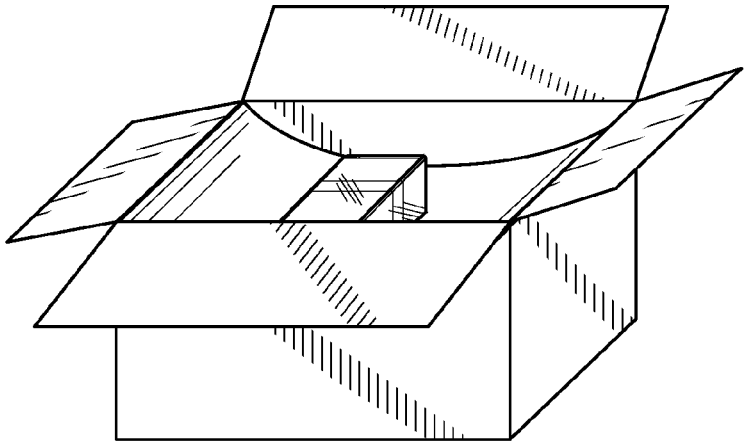
FIG. 28*c* is an exemplary embodiment of a packaging assembly in accordance with the present disclosure which is ready to be sealed and including structures similar to those represented in FIGS. 27-29.

Referring now to FIG. 28*c*, there is shown an illustrative embodiment of a package assembly which is ready to be sealed for storage or shipment which includes structures from FIGS. 28*a*-28*c*.

Figure 29:
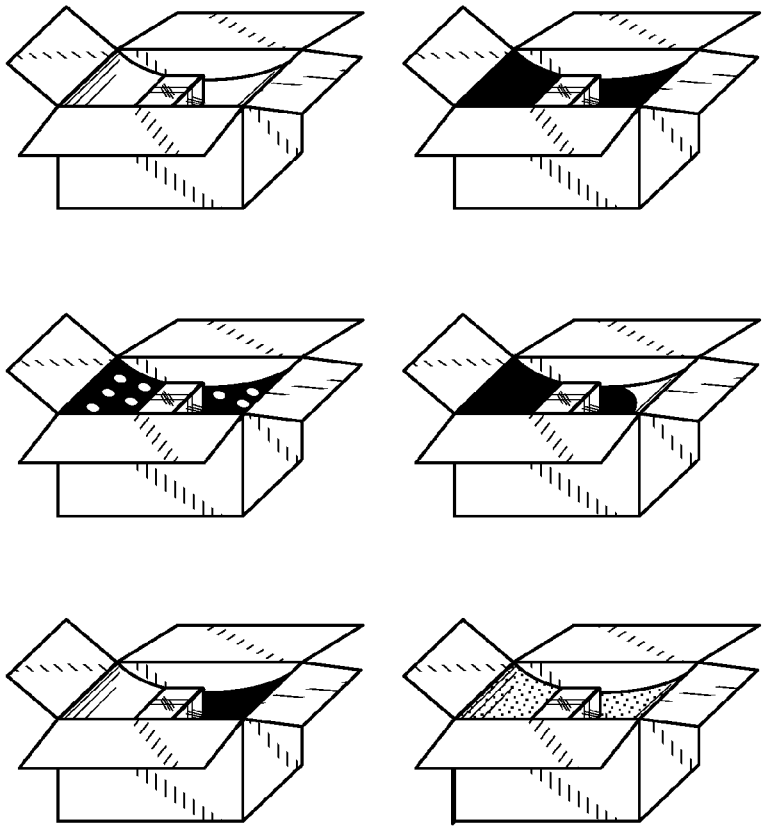
FIG. 29 represents a variety of exemplary embodiments of a packaging assembly in accordance with the present disclosure.

Referring now to FIG. 29, there are shown illustrative embodiments of package assembly structures representing various decorative aspects of the packaging assembly. Decorative aspects may include color, texture, and prints. The decorative aspects may further include festive themes or business themes. The decorative inserts may include instructions to the end user or may include advertisements. The inserts may be covered in a covering such as a material to provide texture or other visual and tactile impressions.

Figure 30A:
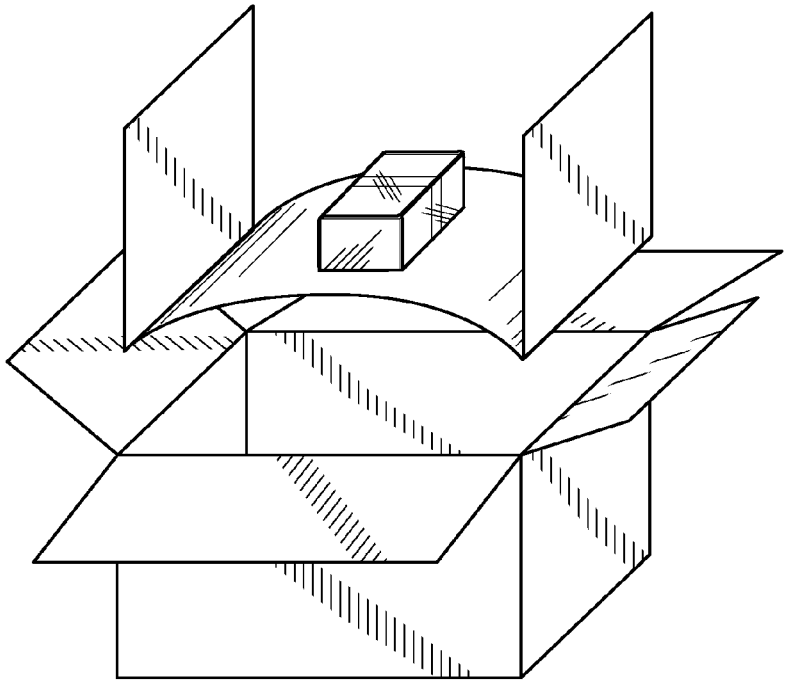
FIG. 30*a* is still another exemplary embodiment of a packaging assembly in accordance with the present disclosure.

Referring now to FIG. 30*a*, there is shown an illustrative embodiment of package assembly members shown in expanded view ready to be inserted in an arched up configuration into a container.

Figure 30B:
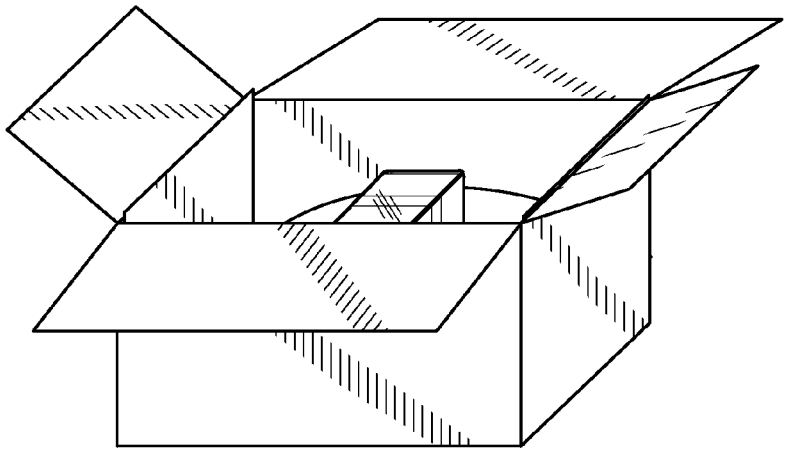
FIG. 30*b* is yet another exemplary embodiment of a packaging assembly in accordance with the present disclosure.

Referring now to FIG. 30*b*, there is shown an illustrative embodiment of a package assembly ready to be closed with the arched up configuration similar to the structures of FIG. 30*a*.

Figure 31:
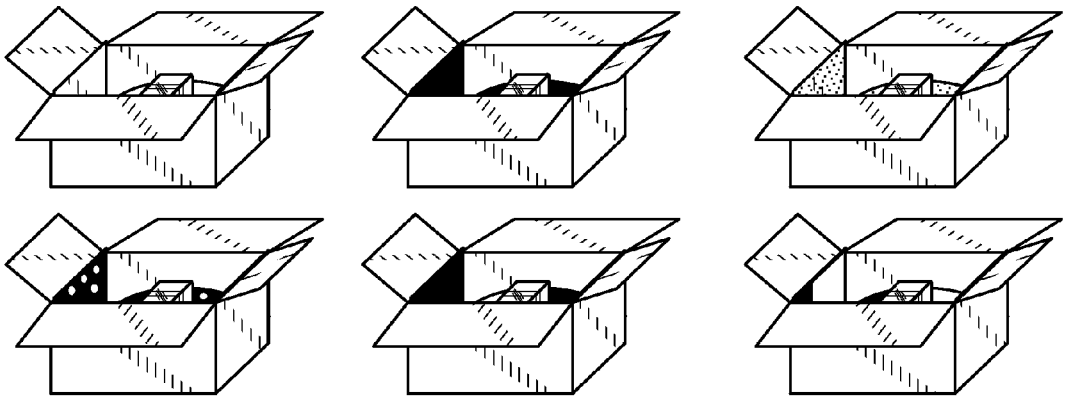
FIG. 31 represents a number of exemplary embodiments of a packaging assembly in accordance with the present disclosure.

Referring now to FIG. 31, there are shown alternative illustrative embodiments of package assemblies similar to the structures of FIGS. 30*a*-30*b* in accordance with the present disclosure illustrating various potential decorative aspects of the packaging assembly. Decorative aspects may include color, texture, and prints. The package assembly may also be configured as primary packaging ready for retail display and presentation. The decorative aspects may further include festive themes or business themes. The decorative inserts may include instructions to the end user or may include advertisements. The inserts may be covered in a covering such as a material to provide texture or other visual and tactile impressions.

In view of the foregoing, those having ordinary skill in the relevant art will appreciate the advantages provided by the features of the present disclosure. Those advantages comprising, inter alia, cost savings, economy of storage, and the ability to fine-tune the properties of the packaging.

In the foregoing Detailed Description, various features of the present disclosure are grouped together in single embodiments for the purpose of streamlining the disclosure. This method of disclosure is not to be interpreted as reflecting an intention that the claimed disclosure requires more features than are expressly recited in each claim hereinafter presented. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set fourth herein.

What is claimed is:

1. A package assembly, the assembly comprising:

a container comprising inside surfaces, a packaging assembly comprising an arched member disposed within said container, and wherein said arched member provides suspension within the container, wherein said arched member comprises an arched portion and vertical portions disposed on opposing ends of said arched portion, such that the arched portion is in direct mechanical communication with the vertical portions so that said arched portion is directly supported by said vertical portions, to thereby suspend a packaged article away from said inside surfaces of said container, when said packaging assembly is disposed within said container, wherein said arched member further comprises a resilient member, a retention member and a framing member, which are distinct, individual components that are configured as layers that together form said arched portion of said arched member, wherein said framing member comprises an opening, and wherein the article is located between the resilient member on one side and the retention member and the framing member on the opposite side, such that the packaging assembly is assembled by bringing the resilient member into contact with the framing member, thereby forcing the retention member to conform to the shape of the article as the article is forced through the opening of the framing member.

2. The package assembly of claim 1 wherein the retention member is configured to interface with the framing member.

3. The package assembly of claim 2 wherein the resilient member, the retention member and the framing member are substantially the same size.

4. The package assembly of claim 2 wherein the resilient member, the retention member and the framing member are substantially the same shape.

5. The package assembly of claim 2 wherein said retention member is elastically deformed.

6. The package assembly of claim 2 wherein said retention member is plastically deformed.

7. The package assembly of claim 2 wherein said retention member is attached to said framing member with adhesive.

8. The package assembly of claim 5 wherein said retention member is deformed by the framing member.

9. The package assembly of claim 6 wherein said retention member is deformed by the framing member.

10. A packaging assembly, the assembly comprising:

an arched member comprising an arched portion and vertical portions disposed on opposing ends of said arched portion of said arched member, and wherein said arched member provides suspension, wherein the arched portion is in direct mechanical communication with the vertical portions of said arched member so that said arched portion is directly supported by said vertical portions, to thereby suspend a packaged article within a container, when said packaging assembly is disposed within said container, wherein said arched member comprises a resilient member, a retention member and a framing member, which are distinct, individual components that are configured as layers that together form said arched portion of said arched member, wherein said framing member comprises an opening, and wherein the article is located between the resilient member on one side and the retention member and the framing member on the opposite side, such that the packaging assembly is assembled by bringing the resilient member into contact with the framing member, thereby forcing the retention member to conform to the shape of a packaged article as the article is forced through the opening of the framing member.

11. The packaging assembly of claim 10 wherein the retention member is configured to interface with the framing member.

12. The packaging assembly of claim 11 wherein the resilient member, the retention member and the framing member are substantially the same size.

13. The packaging assembly of claim 11 wherein the resilient member, the retention member and the framing member are substantially the same shape.

14. The packaging assembly of claim 11 wherein said retention member is elastically deformed.

15. The packaging assembly of claim 11 wherein said retention member is plastically deformed.

16. The packaging assembly of claim 11 wherein said retention member is attached to said framing member with adhesive.

17. The packaging assembly of claim 14 wherein said retention member is deformed by the framing member.

18. The packaging assembly of claim 15 wherein said retention member is deformed by the framing member.

19. A system for packaging and transporting for retail comprising:

an article for packaging, an arched member comprising an arched portion and vertical portions disposed on opposing ends of said arched portion of said arched member, wherein said article is disposed on said arched portion of said arched member and wherein the arched portion is in direct mechanical communication with the vertical portions of said arched member so that said arched portion is directly supported by said vertical portions, to thereby suspend said article, wherein said arched member comprises a resilient member, a retention member and a framing member, which are distinct, individual components that are configured as layers that together form said arched portion of said arched member, wherein said framing member comprises an opening, and wherein the article is located between the resilient member on one side and the retention member and the framing member on the opposite side, such that the packaging assembly is assembled by bringing the resilient member into contact with the framing member, thereby forcing the retention member to conform to the shape of the article for packaging as the article is forced through the opening of the framing member.

20. The system of claim 19 wherein said arched member is configured as primary packaging.

21. The system of claim 19 wherein said arched member comprises a hang tag for configured for hanging in a display.

* * * * *